US006141639A

United States Patent [19]

Thyssen

[11] Patent Number: 6,141,639

[45] Date of Patent: Oct. 31, 2000

[54] METHOD AND APPARATUS FOR CODING OF SIGNALS CONTAINING SPEECH AND BACKGROUND NOISE

[75] Inventor: Jes Thyssen, Laguna Niguel, Calif.

[73] Assignee: Conexant Systems, Inc., Newport Beach, Calif.

[21] Appl. No.: 09/092,663

[22] Filed: Jun. 5, 1998

[51] Int. Cl.[7] ..... G10L 21/00; G10L 19/00

[52] U.S. Cl. ..... 704/219; 704/220; 704/229; 704/226

[58] Field of Search ..... 704/219, 220, 704/229, 206, 208, 228, 226

[56] References Cited

U.S. PATENT DOCUMENTS

| | | | |
|---|---|---|---|
| 5,327,520 | 7/1994 | Chen | 704/219 |
| 5,451,951 | 9/1995 | Elliott et al. | 704/220 |
| 5,596,676 | 1/1997 | Swaminathan et al. | 704/208 |
| 5,717,724 | 2/1998 | Yamazaki et al. | 375/346 |
| 5,734,789 | 3/1998 | Swaminathan et al. | 704/206 |
| 5,774,844 | 6/1998 | Akagiri | 704/229 |
| 5,794,199 | 8/1998 | Rao et al. | 704/258 |
| 5,930,749 | 7/1999 | Maes | 704/228 |
| 5,956,674 | 9/1999 | Smyth et al. | 704/229 |

FOREIGN PATENT DOCUMENTS

| | | |
|---|---|---|
| 0 653 846 A1 | 12/1994 | European Pat. Off. . |
| WO 92/22891 | 12/1992 | WIPO . |
| WO 97/15983 | 5/1997 | WIPO . |

OTHER PUBLICATIONS

Excerpt from "Discrete–Time Processing of Speech Signals," Chapter 8, by John R. Deller, Jr., et al, pp. 506–517, 1993.

"ITU–T Recommendation G.729," by International Telecommunication Union, Mar., 1996.

Variable Bit –Rate CELP Coding of Speech with Phonetic Classification, European Transactions on Telecomunications and Related Technologies, vol. 5 (1994) Sep./Oct., No. 5 Milano, IT.

*Primary Examiner*—David R. Hudspeth
*Assistant Examiner*—Susan Wieland
*Attorney, Agent, or Firm*—Price and Gess

[57] ABSTRACT

A signal including speech and background noise is encoded by first decomposing the signal into speech and noise components. A first speech encoding algorithm is then used to generate codebook indices for the speech component and a second algorithm is applied to generate codebook indices for the noise component. The speech encoding algorithm performs better since it faces clean speech, while a simple, very low bit rate algorithm may be used to encode the noise.

28 Claims, 4 Drawing Sheets

METHOD AND APPARATUS FOR CODING OF SIGNALS CONTAINING SPEECH AND BACKGROUND NOISE

BACKGROUND OF THE INVENTION

1. Field of the Invention

The subject invention relates generally to communication systems and more particularly to a method for encoding speech which faithfully reproduces the entire input signal including the speech and attendant noise.

2. Description of Related Art

In speech coding, the input signal can be either clean or have additive acoustical background noise. The latter has become more and more common as the use of cellular phones has increased. It is commonly known that todays lower-rate (<12 kbit/s) speech coders handle the background noise conditions inadequately. The problem is that the algorithms designed for speech coding are highly specialized for speech, and handle other input signals (e.g. acoustical noise) poorly due to a significant difference in the statistics of the signals and the perceptually important aspects of the signals.

In an effort to combat this problem, persons in the art have resorted to adjusting the speech coding algorithm to better accommodate the background noise without sacrificing the speech quality too much. Other proposed solutions make use of noise suppression on the input signal before the encoding. This approach however is unable to faithfully reproduce the original input signal. Several cellular phone standards apply the approach of noise suppression.

OBJECTS AND SUMMARY OF THE INVENTION

The present invention addresses the problem of coding speech in the presence of acoustical background noise by a decomposition of the input signal into two parts: 1) the background noise, and 2) the clean speech. The two components are coded separately, and combined at the decoder to produce the final output. Since the two components are separated, an encoding algorithm can be tailored to each component. While a traditional speech coding algorithm handles the noise poorly, a very simple, very low bit-rate noise encoding algorithm is sufficient to produce a perceptually accurate reconstruction of the noise. Furthermore, the speech coding algorithm faces clean speech, and thus the speech coding algorithm will code a signal to which its models fits well, and thus will perform better.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventors of carrying out his invention. Various modifications, however, will remain readily apparent to those skilled in the art.

Figure 1:
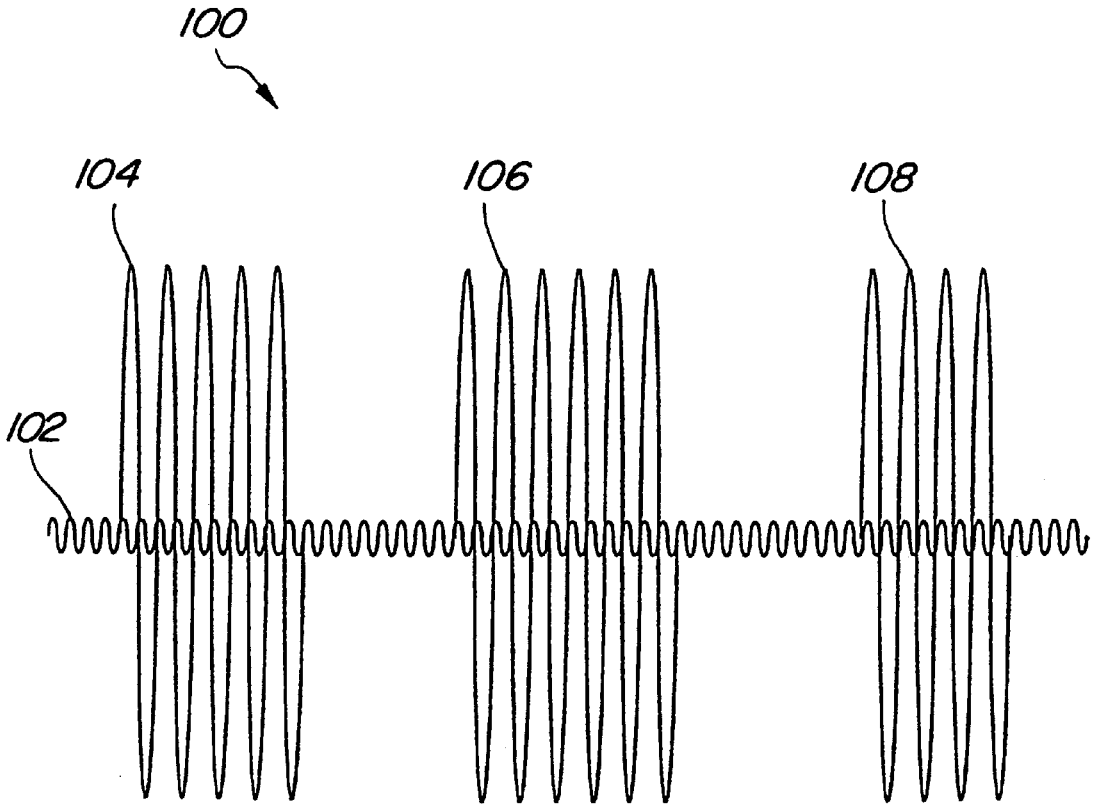
FIG. 1 PRIOR ART
FIG. 1 illustrates the analog sound waves of a typical speech conversation, which includes ambient background noise throughout the signal.

During a conversation between two or more people, ambient background noise is typically inherent to the overall listening experience of the human ear. FIG. 1 illustrates the analog sound waves 100 of a typical recorded conversation that includes ambient background noise signal 102 along with speech groups 104–108 caused by voice communication. Within the technical field of transmitting, receiving, and storing speech communications, several different techniques exist for coding and decoding a signal 100. One of the techniques for coding and decoding a signal 100 is to use an analysis-by-synthesis coding system, which is well known to those skilled in the art.

Figure 2:
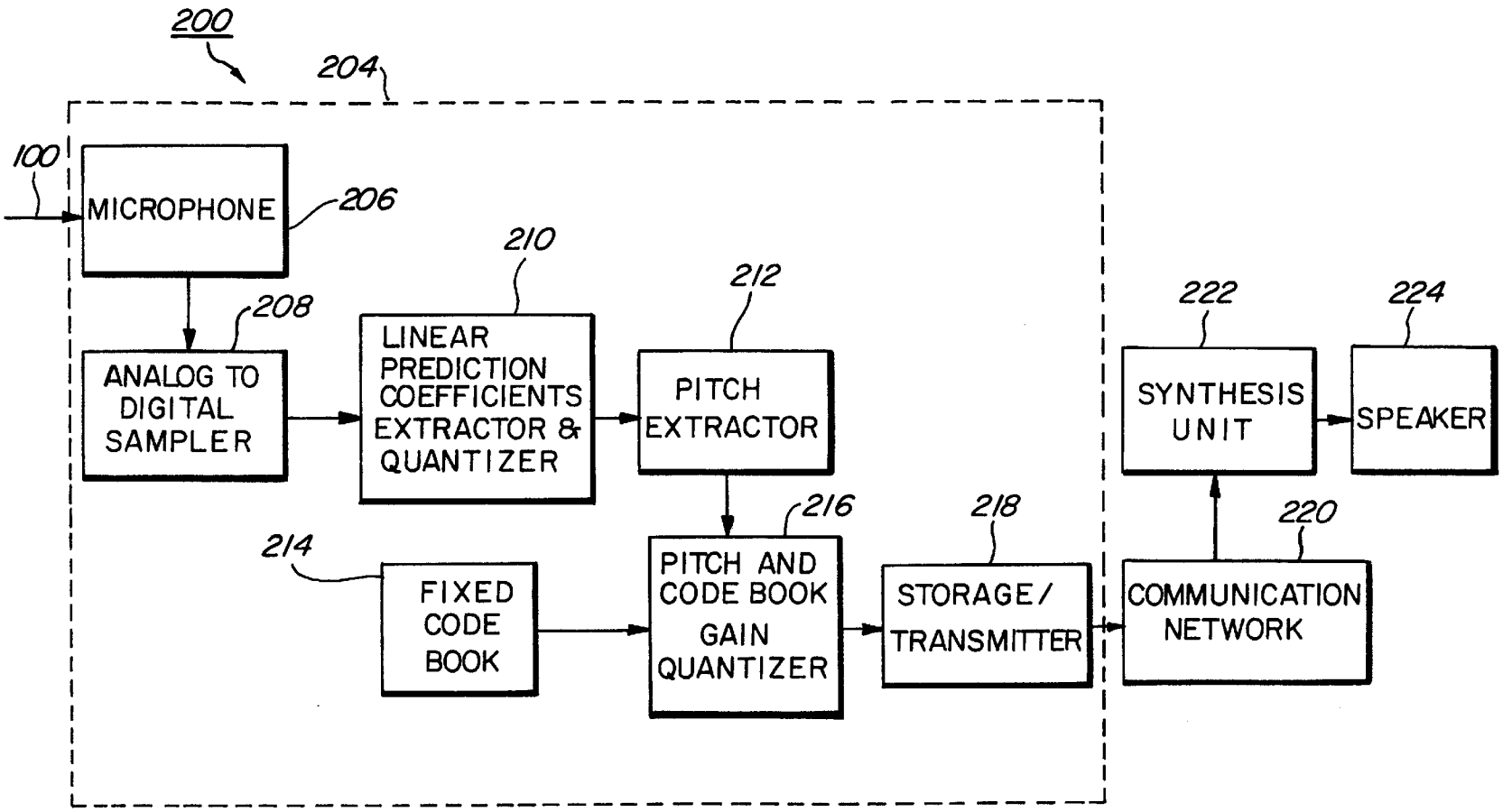
FIG. 2 PRIOR ART
FIG. 2 illustrates a block diagram of a prior art analysis-by-synthesis system for coding and decoding speech.

FIG. 2 illustrates a general overview block diagram of a prior art analysis-by-synthesis system 200 for coding and decoding speech. An analysis-by-synthesis system 200 for coding and decoding signal 100 of FIG. 1 utilizes an analysis unit 204 along with a corresponding synthesis unit 222. The analysis unit 204 represents an analysis-by-synthesis type of speech coder, such as a code excited linear prediction (CELP) coder. A code excited linear prediction coder is one way of coding signal 100 at a medium or low bit rate in order to meet the constraints of communication networks and storage capacities. An example of a CELP based speech coder is the recently adopted International Telecommunication Union (ITU) G.729 standard, herein incorporated by reference.

In order to code speech, the microphone 206 of the analysis unit 204 receives the analog sound waves 100 of FIG. 1 as an input signal. The microphone 206 outputs the received analog sound waves 200 to the analog to digital (A/D) sampler circuit 208. The analog to digital sampler 208 converts the analog sound waves 100 into a sampled digital speech signal (sampled over discrete time periods) which is output to the linear prediction coefficients (LPC) extractor 210 and the pitch extractor 212 in order to retrieve the formant structure (or the spectral envelope) and the harmonic structure of the speech signal, respectively.

The formant structure corresponds to short-term correlation and the harmonic structure corresponds to long-term correlation. The short term correlation can be described by time varying filters whose coefficients are the obtained linear prediction coefficients (LPC). The long term correlation can also be described by time varying filters whose coefficients are obtained from the pitch extractor. Filtering the incoming speech signal with the LPC filter removes the short-term correlation and generates a LPC residual signal. This LPC residual signal is further processed by the pitch filter in order to remove the remaining long-term correlation. The obtained signal is the total residual signal. If this residual signal is passed through the inverse pitch and LPC filters (also called synthesis filters), the original speech signal is retrieved or synthesized. In the context of speech coding, this residual signal has to be quantized (coded) in order to reduce the bit rate. The quantized residual signal is called the excitation signal which is passed through both the quantized pitch and LPC synthesis filters in order to produce a close replica of the original speech signal. In the context of analysis-by-synthesis CELP coding of speech, the quantized residual is obtained from a code book 214 normally called the fixed code book. This method is described in detail in the ITU G.729 document, incorporated by reference herein.

Figure 3:
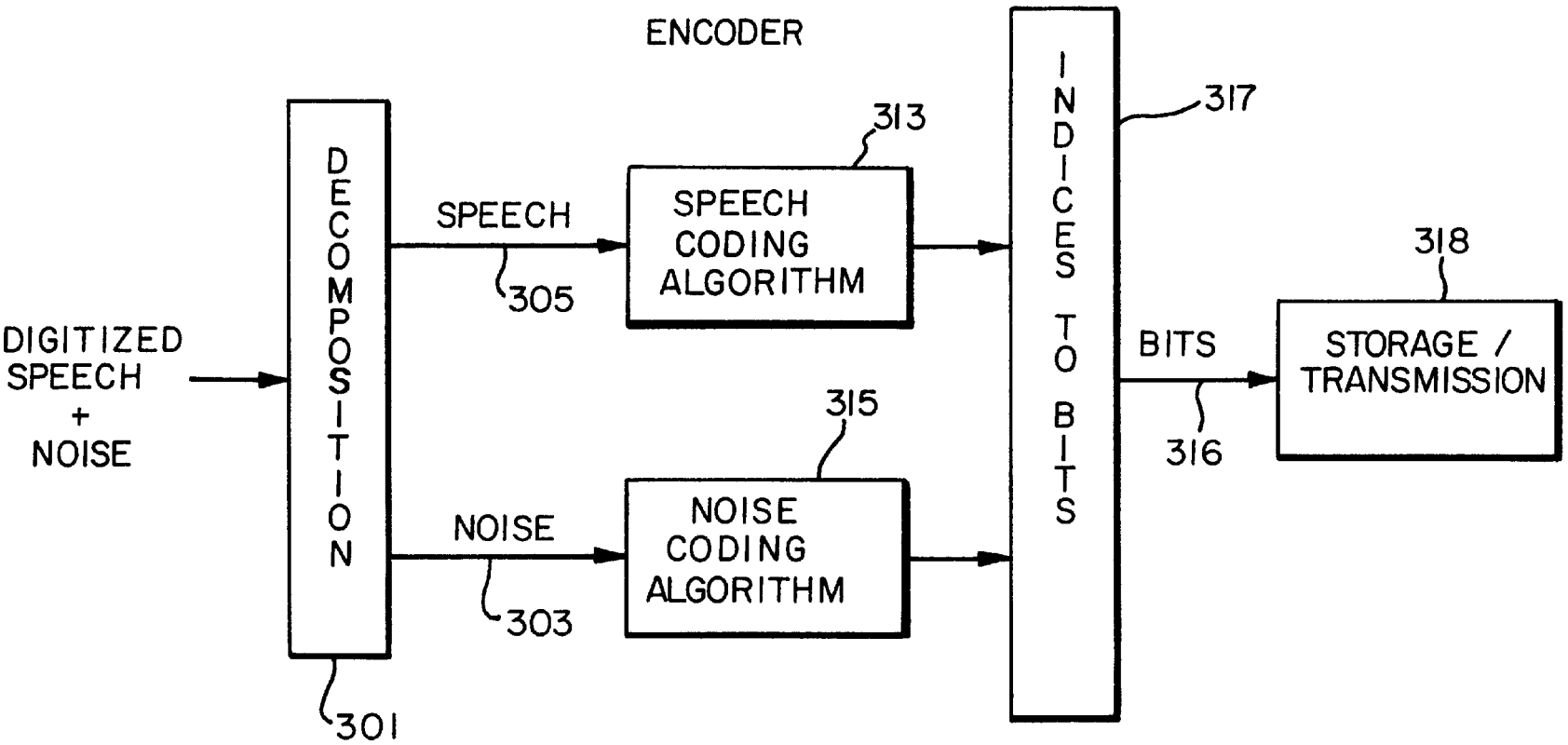
FIG. 3 is a process diagram illustrating an encoder according to the preferred embodiment of the invention.

The method of speech coding according to the preferred embodiment is illustrated in FIG. 3. According to step 301 of FIG. 3, the digitized speech and noise input is decomposed into two parts: the digitized background noise 303 and the digitized clean speech 305. The decomposition 301 can be carried out by spectral subtraction, noise reduction or other techniques usually used for speech enhancement.

As appreciated by those skilled in the art, spectral subtraction is a technique wherein speech is modeled as a random process to which uncorrelated random noise is added. The estimated noise power spectrum is subtracted from the transformed noisy input signal. It is assumed that the noise is short-term stationary, with second-order statistics estimated during silent frames (single-channel) or from a reference channel (dual-channel). Spectral subtraction per se is well-known in the art and various implementations are illustrated, for example, in the text entitled *Discrete-Time Processing of Speech Signals* by Deller, Jr.; Proakis; and Hansen published by Prentice-Hall, Upper Saddle River, N.J., incorporated herein by reference.

Once the input signal has been decomposed, the speech signal 305 is encoded separately from the background noise signal 303. A traditional speech coding algorithm 313 such as ITU G.729 may be used to code the speech signal 305, while a very low bit-rate algorithm 315 is used to produce a perceptually accurate reconstruction of the noise 303.

The noise coding algorithm 315 is preferably tailored to the decomposition algorithm in order to catch the signal characteristics piped to the noise component. As an example, the noise coding algorithm 315 could consist of only two parameters; 1) the overall energy, 2) the spectral envelope (LPC). Here, a coding rate of approximately 700–1000 bits/second suffices. Since the estimate of the noise component is typically based on some averaging, the noise parameters will evolve slowly, and thus a low bit-rate is sufficient. As an excitation signal for the noise LPC filter, a Guassian random signal (locally generated) with an energy in accordance with the overall energy may be used.

The two algorithms implemented in steps 313 and 315 each produce a series of codebook indices like those generated according to G.729. In step 317, the indices are converted to a bit-stream 316 for either storage or transmission in step 318.

Figure 4:
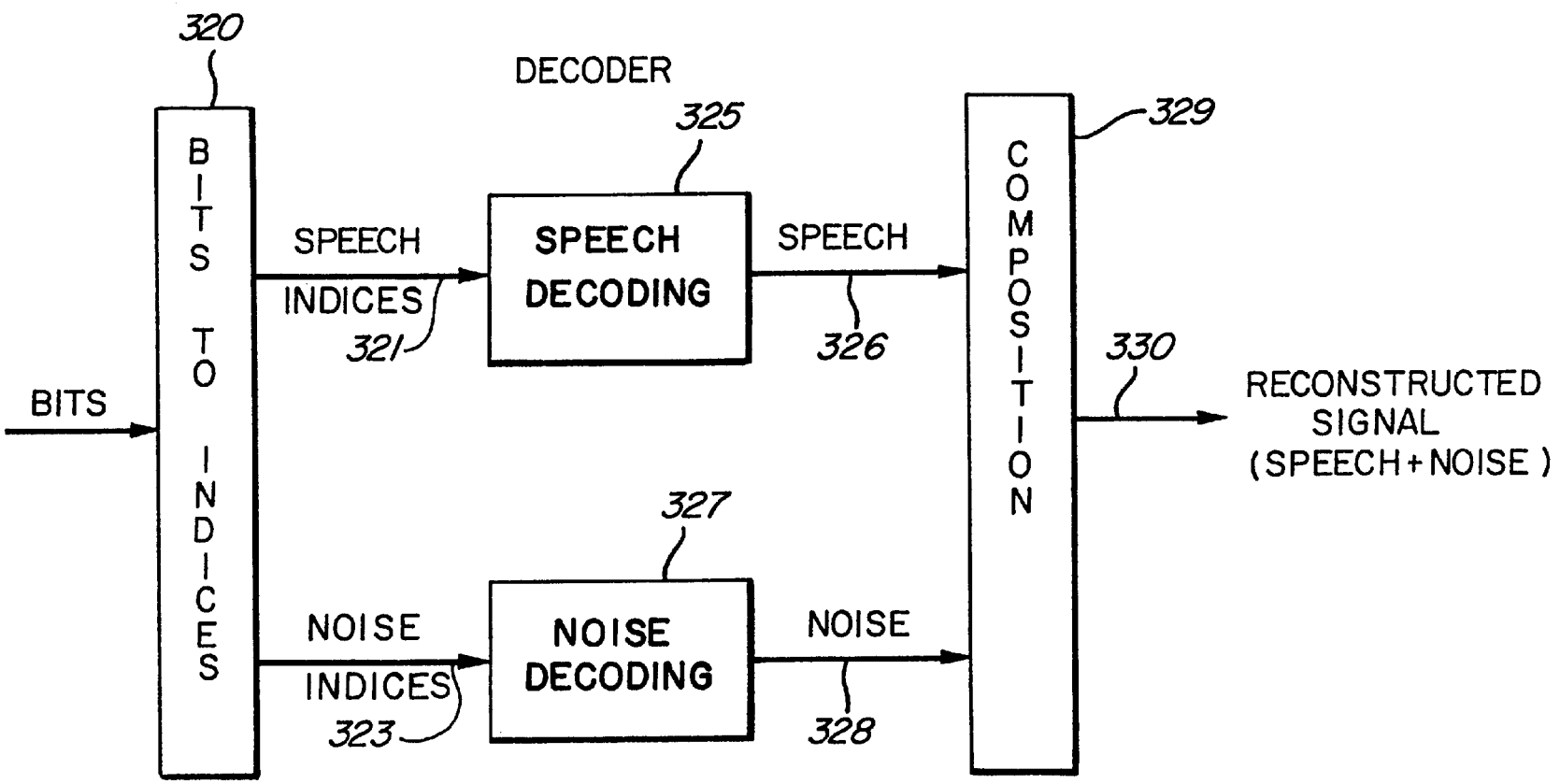
FIG. 4 is a process diagram illustrating a decoder according to the preferred embodiment of the invention.

As illustrated in FIG. 4, during reconstruction, the bitstream is converted back to speech and noise indices 321, 323 at step 320, and the speech and noise components 326, 328 are generated from these indices by respective decoding algorithms 325, 327. The components 326, 328 are combined at step 329 to form the final output 330. The combination 329 can be a simple addition of the two components 326, 328 but in general will depend on the decomposition method.

The above description has dealt with a decomposition into two parts 1) background noise and 2) clean speech. Since combining the two components without coding will give perfect reconstruction, the decomposition is lossless. However, in some situations, it can be advantageous to apply a lossy decomposition. For example, by applying perceptual masking models, information can be discarded as an integral part of the decomposition and facilitate the coding of either/both of the two components. Hence, even though the signal cannot be reconstructed without loss in this case, the reconstruction is still accurate from a perceptual point of view.

Implementation of the above described method enables a faithful reproduction of the entire input signal including the acoustical background noise. Previous lower rate speech coders either reproduce the background noise with annoying distortion or apply noise suppression to the input signal, and thereby are not able to faithfully reproduce the acoustical background noise. Any speech coder at lower bit-rate (<12 kbit/s) will benefit from the invention. As those skilled in the art will appreciate, the subject method is preferably implemented using a programmed digital processor, for example, such as a microprocessor.

The description is focused on a decomposition performed in the speech domain. However, the basic idea of the proposed method can also be applied in the LPC-residual domain since the spectral envelope is an important part of both the speech and the noise components.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A method of encoding a signal that contains both speech and background noise for communicating the speech and noise containing signal, the method comprising the steps of:

decomposing the speech and noise containing signal into a speech containing signal and a separate noise containing signal;

encoding the speech containing signal by use of an algorithm suitable for speech encoding;

encoding the noise containing signal by use of an algorithm suitable for noise encoding; and communicating the encoded speech signal and the encoded noise signal.

2. The method of claim 1 wherein the noise encoding step is performed at the same time as the speech encoding step, and the noise encoding step uses an algorithm that employs a lower coding rate than the coding rate of the speech encoding algorithm.

3. The method of claim 1 wherein the algorithm used in the speech encoding step is designed to encode speech signals.

4. The method of claim 3 wherein the algorithm used in the noise encoding step operates at a coding rate of 1,000 bits/second or less.

5. The method of claim 1 wherein the algorithm used in the speech encoding step generates codebook indices, and the algorithm used in the noise encoding step generates codebook indices.

6. The method of claim 5 further comprising the step of converting the codebook indices into a bit stream for communication.

7. The method of claim 6 further comprising the step of converting a received bit stream into speech codebook indices and noise codebook indices.

8. The method of claim 7 further comprising the step of converting the speech codebook indices and noise codebook indices to reconstruct the communicated speech and noise containing signal.

9. The method of claim 5 wherein the algorithm used in the noise encoding step employs a lower coding rate than the coding rate of the speech encoding algorithm.

10. The method of claim 5 wherein the algorithm used in the speech encoding step is designed to encode speech signals.

11. The method of claim 10 wherein the algorithm used in the noise encoding step operates at a coding rate of 1,000 bits/second or less.

12. The method of claim 1 wherein the decomposing step comprises spectral subtraction.

13. The method of claim 12 wherein the noise encoding step is performed at the same time as the speech encoding step, using an algorithm that employs a lower coding rate than the coding rate of the speech encoding algorithm.

14. The method of claim 13 wherein the algorithm used in the noise encoding step operates at a coding rate of 1,000 bits/second or less.

15. The method of claim 13 wherein the algorithm used in the speech encoding step generates codebook indices, and the algorithm used in the noise encoding step generates codebook indices.

16. The method of claim 15 further comprising the step of converting the codebook indices into a bit stream for communication.

17. The method of claim 16 further comprising the step of converting a received bit stream into speech codebook indices and noise codebook indices.

18. The method of claim 17 further comprising the step of converting the speech codebook indices and noise codebook indices to reconstruct the communicated speech and noise containing signal.

19. Apparatus for encoding a signal containing speech and background noise for communicating the speech over a communication link, the apparatus comprising:

a signal decomposition apparatus receiving a digitized speech signal containing background noise, and generating a digitized speech component and a separate digitized noise component;

a first encoder receiving the digitized speech component, and encoding the speech component by using a first algorithm;

a second encoder receiving the digitized noise component and encoding the noise component by using a second different algorithm; and a communication device for receiving the encoded speech and noise components for storage or transmission, as desired.

20. The apparatus of claim 19 wherein said first encoder uses an algorithm designed for encoding speech, and said second encoder uses an algorithm designed to encode noise.

21. The apparatus of claim 20 wherein said first encoder uses an ITU G.729 algorithm.

22. The apparatus of claim 21 wherein said second encoder uses an algorithm that operates at a coding rate of 1,000 bits/second, or less.

23. The apparatus of claim 19 wherein said first encoder uses an ITU G.729 algorithm.

24. The apparatus of claim 19 further comprising:

a transmitting converter receiving the encoded speech and noise components and converting them to a bit stream for storage or transmission.

25. The apparatus of claim 24 further comprising:

a receiving converter for receiving a bit stream and converting it to separate speech and noise indices.

26. The apparatus of claim 25 further comprising:

a first decoder receiving the speech indices and using a first decoding algorithm for decoding the speech indices; and a second decoder receiving the noise indices and using a second decoding algorithm for decoding the noise indices.

27. The apparatus of claim 26 further comprising a composition apparatus receiving the decoded speech and noise indices and combining them to produce the communicated signal.

28. The apparatus of claim 19 wherein the signal decomposition apparatus separates the speech component and noise component from the received signal by spectral subtraction.

* * * * *